United States Patent [19]

Lamb

[11] Patent Number: 4,842,101

[45] Date of Patent: Jun. 27, 1989

[54] ELEVATOR SYSTEM

[75] Inventor: Miles P. Lamb, Somerset, N.J.

[73] Assignee: Westinghouse Electric Corp., Pittsburgh, Pa.

[21] Appl. No.: 156,066

[22] Filed: Feb. 16, 1988

[51] Int. Cl.[4] ..... B66B 11/04

[52] U.S. Cl. ..... 187/22; 254/338; 474/68

[58] Field of Search ..... 187/20, 22, 94, 27; 254/264, 337, 338, 334, 382; 74/89.22, 89.2; 474/66, 68

[56] References Cited

U.S. PATENT DOCUMENTS

| | | | |
|---|---|---|---|
| Re. 13,546 | 3/1913 | Potter | 474/68 |
| 567,158 | 9/1896 | Otis | 187/22 |
| 691,276 | 1/1902 | Kottgen | 187/20 |
| 1,098,845 | 6/1914 | Schwab | 187/20 |
| 1,435,082 | 11/1922 | Reedy | 187/94 |
| 1,605,079 | 11/1926 | Simmon | 254/369 |
| 1,730,974 | 10/1929 | Nigbee | 187/20 |
| 1,974,361 | 9/1934 | LaNeve | 187/1 |
| 2,522,614 | 9/1950 | Helling | 187/23 |
| 3,519,101 | 7/1970 | Sieffert | 187/2 |
| 3,690,412 | 7/1970 | Murray | 182/2 |
| 3,707,922 | 1/1973 | Dillon | 254/338 |
| 3,720,291 | 8/1970 | Ivanor | 187/20 |
| 3,838,752 | 10/1974 | Berkovitz | 187/20 |
| 4,013,142 | 3/1977 | Hagg | 187/20 |
| 4,030,569 | 6/1977 | Berkovitz | 187/20 |
| 4,139,178 | 2/1979 | Hippach | 254/175.5 |
| 4,402,488 | 9/1983 | Berkovitz | 254/371 |
| 4,433,755 | 2/1984 | Ohtami | 187/20 |
| 4,566,562 | 1/1986 | Suzuki et al. | 187/22 |
| 4,620,615 | 11/1986 | Morris et al. | 187/22 |

FOREIGN PATENT DOCUMENTS

| | | | |
|---|---|---|---|
| 197042 | 4/1908 | Fed. Rep. of Germany . | |
| 2312449 | 12/1976 | France . | |
| 566100 | 8/1957 | Italy | 187/20 |

*Primary Examiner*—Kevin P. Shaver
*Assistant Examiner*—Kenneth Noland
*Attorney, Agent, or Firm*—D. R. Lackey

[57] ABSTRACT

Methods and apparatus for increasing the tractive force between the wire hoist ropes and the drive sheave of a traction elevator system which includes an elevator car and a counterweight. The drive sheave is disposed between first and second idler or secondary sheaves, and the car and counterweight are roped via successive first and second 180 degree wraps about the drive sheave, with the first 180 degree wrap including the drive sheave and one of the idler sheaves, and the second 180 degree wrap including the drive sheave and the remaining idler sheave. The drive sheave is thus roped with a wrap of approximately 360 degrees, which remains constant regardless of the spacing between the elevator car and counterweight.

8 Claims, 2 Drawing Sheets

ELEVATOR SYSTEM

BACKGROUND OF THE INVENTION

1. Field of the Invention

The invention relates in general to elevator systems, and more specifically to the enhancement of traction in a traction type elevator system to permit the use of a lighter elevator car and counterweight.

2. Description of the Prior Art

Reduction in the dead weight of the elevator car is desirable from a cost viewpoint. In addition to cost savings in the elevator car itself, it enables savings to be made in associated items such as the counterweight, guide rails, safety, traction drive machine, and the building support structure. A lighter elevator car reduces power requirements from the building, as lower peak torques and thus lower currents are required.

A limiting factor in reducing the weight of the elevator car and counterweight however, is the tractive force between the ropes and drive sheave. Sufficient tractive force or traction must be available over the complete range between no-load or empty car, to full load, for the desired acceleration and deceleration rates, or slippage will occur.

The tractive force between the ropes and sheave is governed by the relationship:

$$T1/T2=e^{\mu\theta}$$

where:

T1=rope tension on the car side of the drive sheave

T2=rope tension on the counterweight side of the drive sheave e=base of natural logarithms $\mu$=the effective coefficient of friction between the rope and drive sheave for the groove geometry employed $\theta$=angle of wrap or contact between the ropes and drive sheave.

In the prior art, sheave grooves are often undercut to increase the effective coefficient of friction, but only so much can be done in this regard as the resulting increased pressures on the ropes and sheave grooves shorten both rope and sheave life. Special high traction lubricants have been applied to the ropes to increase the effective coefficient of friction. Sheave grooves have also been lined with a treaded elastomeric material, and arrangements have been made which press the ropes more tightly into the sheave grooves. Other arrangements for increasing tractive force relate to increasing the angle of wrap by going from the half or single wrap to a full or double wrap, and even to a 270 degree wrap. Increasing the wrap, however, increases the bearing load on the drive sheave bearings, requiring a larger and more costly traction drive machine. The 270 degree wrap erodes the sides of the grooves because of the turning and tilting of the drive components required in order to prevent interference between the ropes.

SUMMARY OF THE INVENTION

Briefly, the present invention increases traction by achieving a rope wrap on the drive sheave of approximately 360 degrees, and this wrap remains constant for any spacing between the car and counterweight. Further, unlike many roping arrangements in which the angle of wrap is increased, the bearing load on the drive sheave is reduced, instead of being increased. Thus, the drive machine may be selected for its torque characteristics without being oversized strictly to accommodate high bearing loads. The 360 degree wrap enables the car and counterweight to be substantially lighter, without the danger of rope slippage, with all the attendant advantages which the lighter car and counterweight reflect throughout the elevator system. The traction with a 360 degree wrap also permits an elevator system to operate at higher rises without compensation for the hoist ropes. This is very desirable feature of the invention, useful in elevator installations where hoist rope compensation is not desired for aesthetic reasons, such as elevators mounted on outside walls and in atriums of hotels.

The 360 degree wrap is achieved by alternate 180 degree wraps about the drive via first and second idler or secondary sheaves. The first and second idler sheaves are spaced according the elevator duty, ie., the spacing between the car and counterweight. With relatively close spacing, the drive sheave, which is centered between the first and second idler sheaves, is mounted above a horizontal plane which intersects the rotational axes of the idler sheaves. As the duty and thus the weight of the car and counterweight increase, the drive sheave is mounted closer and closer to the above mentioned horizontal plane, and when the spacing permits, the rotational axis of the drive sheave is moved into the horizontal plane. In all positions of the drive sheave, bearing force components cancel, reducing the bearing load on the drive sheave, with the bearing forces reducing as the drive sheave is moved toward the horizontal plane. The bearing forces are at the minimum point when the rotational axes of the drive sheave and first and second idler sheaves are in a common plane, with such forces being substantially zero when the weight of the car and its load equals the weight of the counterweight, and otherwise only being the relative small forces related to the unbalance between the car and the counterweight.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
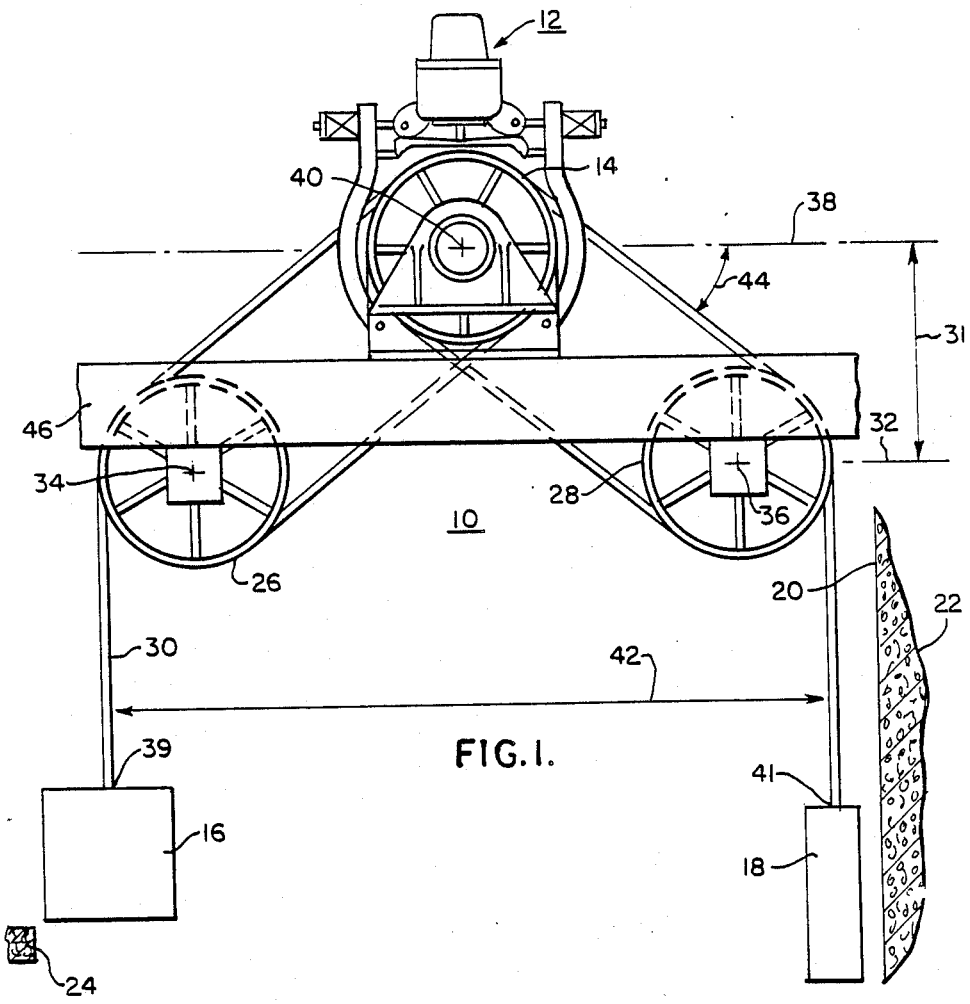
FIG. 1 is an elevational view of a traction elevator system constructed according to the teachings of the invention, illustrating the drive sheave mounted above a plane which intersects the rotational axes of first and second spaced idler sheaves.

Referring now to the drawings, FIG. 1 is an elevational view of a traction elevator system 10 constructed according to a first embodiment of the invention. Elevator system 10 includes a traction drive machine 12 having a drive or traction sheave 14, an elevator car 16, and a counterweight 18. Elevator car 16 and counterweight 18 are mounted for guided vertical movement in normal travel paths in a hoistway 20 of a building 22 having a plurality of floors, such as floor 24. Elevator car 16 and counterweight 18 are driven in their respective travel paths via drive sheave 14, first and second spaced idler sheaves 26 and 28, respectively, and a roping arrangement constructed according to the teachings of the invention which includes a plurality of wire ropes, with the wire ropes being indicated generally at 30. For purposes of example, ends 39 and 41 of the ropes 30 are illustrated as being directly connected to the car 16 and counterweight 18 in a 1 to 1 roping arrangement. It is to be understood, however, that the invention applies equally to 2 to 1 roping, with either the car 16 or counterweight 18, or both, being roped 2 to 1. In 2 to 1 roping, a sheave is mounted on the element to be roped 2 to 1 and the ropes are reeved about the sheave and dead-ended at an overhead beam.

Figure 5:
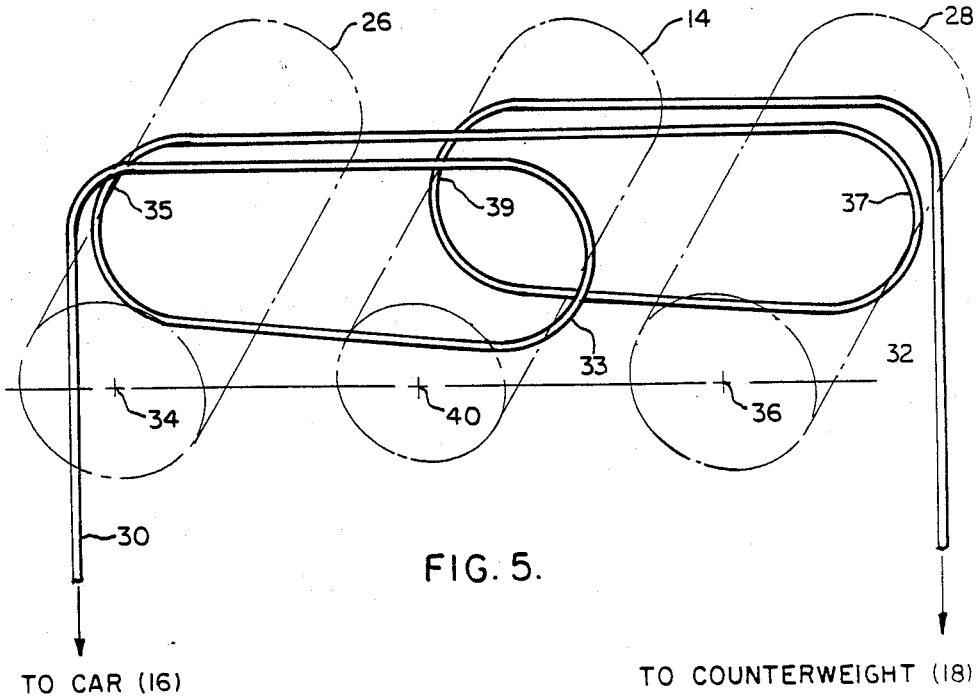
FIG. 5 is a perspective view of how one rope first engages the drive sheave and one of the idler sheave with a full or 180 degree wrap, and then how the same rope engages the drive sheave and the other of the idler sheaves with a 180 degree wrap.

The invention alternates 180 degree wraps of the drive sheave 14, first with one of the idler sheaves, and then with the other. For purposes of example, the roping arrangement will be described relative to a single rope, with a single rope also being referred to with reference 30. More specifically, as best shown in FIG. 5, rope 30 extends from the car 16 and intersects the periphery of the first idler sheave 26, forming, in effect, a vertical tangent thereof. Rope 30 continues to the drive sheave 14 where it makes a first 180 degree wrap 33 on the drive sheave 14, and it returns to the first idler sheave 26 where it makes a 180 degree wrap 35. Rope 30 then crosses over the top of the drive sheave 14 as it proceeds to the second idler sheave 28 where it makes a 180 degree wrap 37. Rope 30 then returns to the drive sheave 14, making a second 180 degree wrap 39 about the drive sheave 14. Rope 30 then crosses over a portion of the second idler sheave 28 as it proceeds downwardly from a vertical tangent thereof to the counterweight 18, completing the roping arrangement for one rope. The remaining ropes are roped in precisely the same way.

Figure 4:
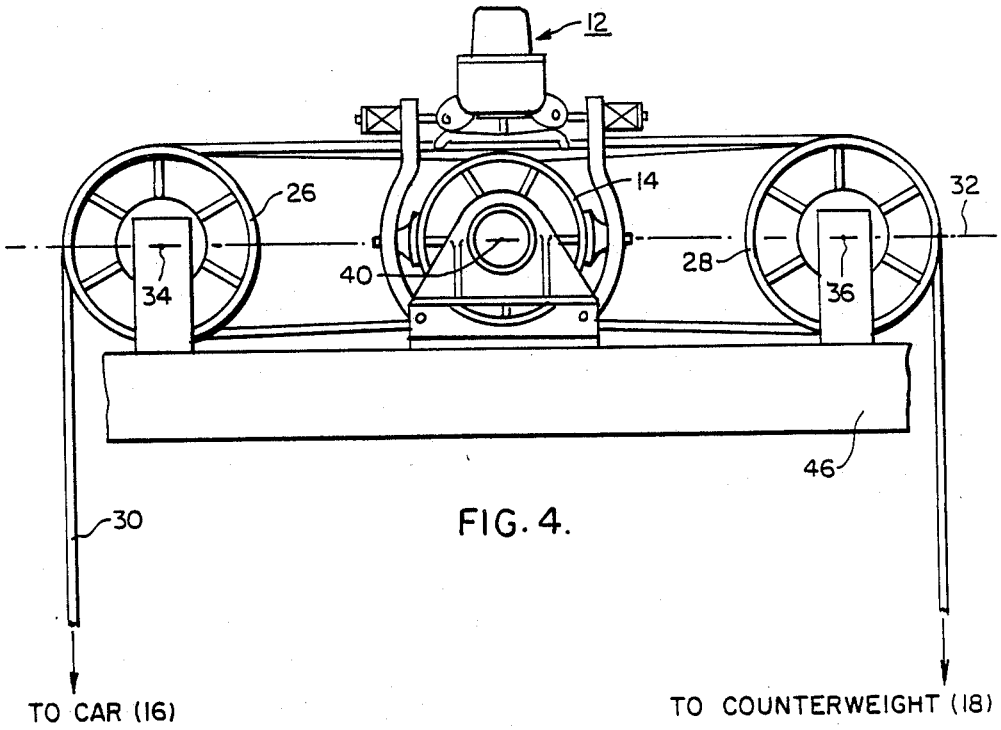
FIG. 4 illustrates a preferred embodiment of the invention when the spacing between the car and hoist ropes permits, with the rotational axes of the drive sheave and idler sheaves being in a common plane, with this configuration resulting in maximum cancellation of bearing forces on the drive sheave.

It will be noted in FIG. 1 that the drive sheave 14 is disposed intermediate and above the first and second idler sheaves 26 and 28, respectively. In a preferred embodiment of the invention, the drive sheave 14 is centrally disposed between the idler sheaves 26 and 28. The spacing 31 between a plane 32 which passes through the rotational axes 34 and 36 of the first and second idler sheaves 26 and 28, respectively, and a parallel plane 38 which passes through the rotational axis 40 of drive sheave 14 is determined by the elevator duty, ie., the spacing 42 between the vertical portions of the ropes 30 which extend downwardly to the elevator car 16 and the counterweight 18, and the diameters of the drive sheave 14 and the first and second idler sheaves 26 and 28. In order to limit bending stresses in the ropes 30, the sheaves have a minimum diameter of about 28 inches. For relatively light duties the downward angle 44 of the ropes 30 from a horizontal plane may be quite large, decreasing as the duties increase to where the planes 32 and 38 coincide, as shown in the FIG. 4 embodiment of the invention. Thus, in the FIG. 1 embodiment, the traction drive machine 12 is mounted in a machine room on overhead beams indicated generally at 46, and the first and second idler sheaves 26 and 28 are suspended from the bottom of beams 46. In the FIG. 4 embodiment, in which the rotational axes 40, 34 and 36 of the drive sheave 14 and the first and second idler sheaves 26 and 28, respectively, are in a common plane 32, the traction drive machine 12 and first and second idler sheaves 26 and 28 are all mounted on top of beams 46.

Figure 3:
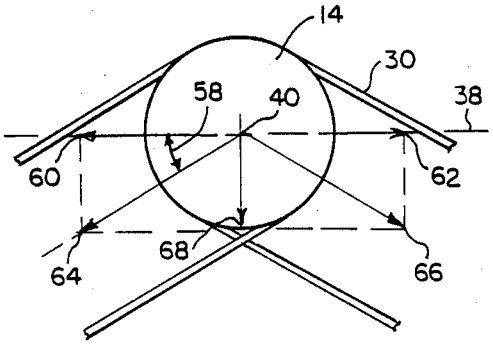
FIG. 3 is similar to FIG. 2, except illustrating how a greater percentage of the bearing forces cancel as the drive sheave is moved towards the plane which intersects the rotational axes of the idler sheaves.
Figure 2:
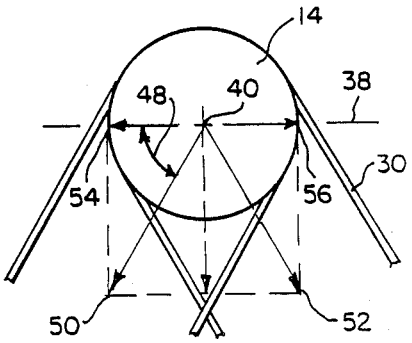
FIG. 2 illustrates the directions of the bearing forces on the drive sheave when the drive sheave is mounted as illustrated in FIG. 1.

Regardless of the dimension of spacing 31 shown in FIG. 1, the present invention reduces loading on the bearings of the drive machine 12. With the ropes 30 making a relatively large angle 48 from a horizontal plane, illustrated in FIG. 2, the loading is illustrated by arrows 50 and 52. Resolving these forces into their horizontal and vertical components results in the horizontal components, represented by arrows 54 and 56, being in opposite directions, and thus the larger cancels the smaller, with only the difference applying a horizontal loading on the bearings of the drive machine 12. As the duty and thus the weight of the car 16 and counterweight increase, the angle 48 from the horizontal plane 38 illustrated in FIG. 2 becomes a smaller angle 58, indicated in FIG. 3, and the horizontal components 60 and 62 of bearing forces 64 and 66, respectively, become larger, resulting in a higher percentage of the bearing forces being cancelled. Thus, the vertical component, indicated by arrow 68, becomes smaller. Finally, when the spacing 42 permits, the rotational axes 40, 34, and 36 of the drive sheave 14 and idler sheaves 26 and 28, respectively, may be placed in a common plane 32, as shown in the FIG. 4 embodiment. In this configuration, the bearing forces and the horizontal components thereof are the same, and there is no vertical component due to rope forces. This results in the minimum bearing loading, with the two opposing bearing forces substantially cancelling when the weight of the car 16 and its load equals the weight of the counterweight 18.

I claim as my invention:

1. A traction elevator system, comprising:

an elevator car, a counterweight, a drive sheave having a rotational axis, first and second idler sheaves having rotational axes, said drive sheave being disposed intermediate said first and second idler sheaves, with the rotational axes of said drive sheave and said first and second idler sheaves all being in parallel relation, and a wire rope interconnecting said elevator car and said counterweight via a roping arrangement which is equally balanced between said drive sheave and said first and second idler sheaves, said rope crossing over said drive sheave to define a mid-point of said balanced roping arrangement, with the rope proceeding from said mid-point to said elevator car via successive 180 degree wraps about said first idler sheave and said drive sheave, and from said mid-point to said counterweight via successive 180 degree wraps about said second idler sheave and said drive sheave, to provide a 360 degree total wrap about said drive sheave.

2. The traction elevator system of claim 1 wherein the rotational axes of the first and second idler sheaves are disposed in a common plane, and the rotational axis of the drive sheave is disposed outside said common plane.

3. The traction elevator system of claim 2 wherein the common plane in which the first and second idler sheaves are disposed is horizontally oriented, and the rotational axis of the drive sheave is disposed above the common plane.

4. The traction elevator system of claim 1 wherein the rotational axes of the drive sheave and of the first and second idler sheaves are disposed in a common plane.

5. The traction elevator system of claim 4 wherein the common plane is horizontally oriented.

6. The traction elevator system of claim 1 wherein the drive sheave is centrally disposed between the first and second idler sheaves.

7. The traction elevator system of claim 1 wherein the wire rope has first and second ends, with the first end being connected to the elevator car and with the second end being connected to the counterweight.

8. The traction elevator system of claim 7 wherein the wire rope extends from the elevator car to the first idler sheave, and from the counterweight to the second idler sheave, occupying vertical tangents to the first and second idler sheaves, respectively.

* * * * *